US007493055B2

(12) United States Patent
German et al.

(10) Patent No.: US 7,493,055 B2
(45) Date of Patent: Feb. 17, 2009

(54) FAULT ISOLATION OF VISIBLE DEFECTS WITH MANUAL MODULE SHUTDOWN OPTIONS

(75) Inventors: Kristine A. German, Webster, NY (US); Robert M. Lofthus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 329 days.

(21) Appl. No.: 11/378,040

(22) Filed: Mar. 17, 2006

(65) Prior Publication Data

US 2007/0217796 A1 Sep. 20, 2007

(51) Int. Cl.
*G03G 15/00* (2006.01)

(52) U.S. Cl. ..... 399/9

(58) Field of Classification Search ..... 399/9
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,095,369 A 3/1992 Ortiz et al.
5,127,012 A * 6/1992 Hiliger ..... 714/46
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Quana M Grainger
(74) *Attorney, Agent, or Firm*—Fay Sharpe LLP; Karl W. Hauber

(57) ABSTRACT

A system for handling objects includes a first image marking engine operative to mark objects, and a second image marking engine operative to mark objects. In addition, the system includes a first object delivery path operative to transport objects presented by the first image marking engine to a first destination. A second object delivery path is operative to transport objects presented by the second image marking engine to a second destination. The first and second destinations may be a single destination, separate destinations, or interchangeable destinations. At least one object is identifiable to isolate at least one aspect of a delivered object. The at least one object includes an associated object itinerary representing at least one object route through the system. A controller is provided to query the object itinerary to correlate the at least one aspect to at least one of the first image marking engine, the second image marking engine, the first object delivery path, and the second object delivery path.

26 Claims, 4 Drawing Sheets

U.S. PATENT DOCUMENTS 5,570,172 A 10/1996 Acquaviva
5,596,416 A 1/1997 Barry et al.
5,629,762 A 5/1997 Mahoney et al.
5,696,893 A 12/1997 Fromherz et al.
5,701,557 A 12/1997 Webster et al.
5,710,968 A 1/1998 Clark et al.
5,778,377 A 7/1998 Marlin et al.
5,884,910 A 3/1999 Mandel
5,940,186 A * 8/1999 Barry et al. ..... 358/296
5,946,521 A * 8/1999 Budnik et al. ..... 399/24
5,995,721 A 11/1999 Rourke et al.
6,059,284 A 5/2000 Wolf et al.
6,125,248 A 9/2000 Moser
6,241,242 B1 6/2001 Munro
6,246,856 B1 * 6/2001 Kopp et al. ..... 399/299
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,819,906 B1 11/2004 Herrmann et al.
6,856,411 B1 2/2005 Purvis et al.
6,856,845 B2 2/2005 Fromherz et al.
6,865,562 B2 3/2005 Fromherz et al.
6,895,292 B2 5/2005 Fromherz et al.
6,898,475 B1 5/2005 Ruml et al.
6,912,515 B2 6/2005 Jackson et al.
6,922,681 B2 7/2005 Fromherz et al.
6,925,283 B1 8/2005 Mandel et al.
6,931,355 B2 * 8/2005 Farrell et al. ..... 702/187
6,959,165 B2 10/2005 Mandel et al.
6,973,286 B2 12/2005 Mandel et al.
2002/0078012 A1 6/2002 Ryan et al.
2002/0103559 A1 8/2002 Gartstein
2003/0077095 A1 4/2003 Conrow
2003/0142985 A1 * 7/2003 Sampath et al. ..... 399/9
2004/0085561 A1 5/2004 Fromherz
2004/0085562 A1 5/2004 Fromherz
2004/0088207 A1 5/2004 Fromherz
2004/0096230 A1 * 5/2004 Furno et al. ..... 399/38
2004/0109699 A1 * 6/2004 Skrainar et al. ..... 399/9
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0247365 A1 12/2004 Lofthus et al.
2006/0033771 A1 2/2006 Lofthus et al.
2006/0039727 A1 2/2006 Lofthus et al.
2006/0039728 A1 2/2006 deJong et al.
2006/0086275 A1 * 4/2006 Fermandez et al. ..... 101/485

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.

* cited by examiner

FAULT ISOLATION OF VISIBLE DEFECTS WITH MANUAL MODULE SHUTDOWN OPTIONS

BACKGROUND

The present exemplary embodiments relate to systems wherein objects are presented, delivered or produced by a plurality of sources and wherein one or more aspects of the presentation, delivery or production of the objects is monitored, measured and/or controlled based on information from a sensor module that is accessible by objects presented, delivered or produced by each of the plurality of object sources. Embodiments will be described in detail in regard to integrated document processing systems. However, embodiments in other object handling or producing systems are also contemplated.

Broadly, document processing systems include input devices, transportation systems and output devices. For example, input devices can include paper trays or drawers. Transportation systems can include conveying devices such as driven nips (spherical or cylindrical), conveyer belts, air jets or vacuums and other mechanisms. Finishing devices can include output trays, staplers, binders, shrink wrappers and bundlers. In the case of printers and copiers, document processors include print engines or integrated image marking engines (IMEs).

In copiers and printers, sheets or webs, such as paper or velum are transported by an interposer, or an interposer system, from paper trays or drawers to a print engine or IME. The IME receives data directing the IME to place marks on the delivered sheet. The IME places the marks (e.g., text or an image) on the sheet and the interposer carries the sheet away for further processing or delivery. The interposer may include a reverser for flipping the sheet to present an opposite side for marking. Additionally, or alternatively the interposer may deliver the sheet to an output device, such as an output tray or a finisher.

There is a desire for systems and methods that identify and associate defects to a particular IME, pathway or transport, feeder, finisher, etc. In addition, there is a desire for controlling print jobs in response to the identification of the source of defects. For integrated document processing systems, prints can be produced from multiple sources. Likewise, there can be multiple paths for transporting sheets through the system. Isolation of the source of a print defect or sheet damage is therefore more complex than for single engine systems. For example, if a spot defect is detected on some pages of a job, either visually or by a sensor, the operator or service representative must be able to isolate not only the type of subsystem creating the spot (such as a contaminated photo receptor), but must also determine which IME is involved. In the case of damaged sheets, the responsible paper path element or transport employed in producing the sheet or print needs to be isolated. Tools for debugging a print system must therefore be available to associate a print defect, shortfall, or variance with the IME that produced the print or the paper path element that caused the damage or fault.

CROSS REFERENCE TO RELATED PATENTS AND APPLICATIONS

The following applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

Application Ser. No. 11/235,979, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

Application Ser. No. 11/236,099, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. application No. 10,761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled. "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/109,996, filed Apr. 20, 2005, entitled "PRINTING SYSTEMS," by Michael C. Mongeon, et al.;

U.S. application Ser. No. 11/115,766, filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. C-I-P application Ser. No. 11/137,273, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/156,778, filed Jun. 20, 2005, entitled "PRINTING PLATFORM," by Joseph A. Swift;

U.S. application Ser. No. 11/157,598, filed Jun. 21, 2005, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/189,371, filed Jul. 26, 2005, entitled "PRINTING SYSTEM," by Steven R. Moore, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM", by Eric Hamby, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS", by Goodman, et al.;

U.S. application Ser. No. 11/234,553, filed Sep. 23, 2005, entitled "MAXIMUM GAMUT STRATEGY FOR THE PRINTING SYSTEMS", by Michael C. Mongeon;

U.S. application Ser. No. 11/234,468, filed Sep. 23, 2005, entitled "PRINTING SYSTEM", by Eric Hamby, et al.;

U.S. application Ser. No. 11/247,778, filed Oct. 11, 2005, entitled "PRINTING SYSTEM WITH BALANCED CONSUMABLE USAGE", by Charles Radulski, et al.;

U.S. application Ser. No. 11/248,044, filed Oct. 12, 2005, entitled "MEDIA PATH CROSSOVER FOR PRINTING SYSTEM", by Stan A. Spencer, et al.;

U.S. application Ser. No. 11/274,638, filed Nov. 15, 2005, entitled "GAMUT SELECTION IN MULTI-ENGINE SYSTEMS," by Wencheng Wu, et al.;

U.S. application Ser. No. 11/287,177, filed Nov. 23, 2005, entitled "MEDIA PASS THROUGH MODE FOR MULTI-ENGINE SYSTEM," by Barry P. Mandel, et al.;

U.S. application Ser. No. 11/287,685, filed Nov. 28, 2005, entitled "MULTIPLE IOT PPHOTORECEPTOR BELT SEAM SYNCHRONIZATION," by Kevin M. Carolan;

U.S. application Ser. No. 11/291,860, filed Nov. 30, 2005, entitled "MEDIA PATH CROSSOVER CLEARANCE FOR PRINTING SYSTEM," by Keith L. Willis;

U.S. application Ser. No. 11/292,388, filed Nov. 30, 2005, entitled "PRINTING SYSTEM," by David A. Mueller;

U.S. application Ser. No. 11/292,163, filed Nov. 30, 2005, entitled "RADIAL MERGE MODULE FOR PRINTING SYSTEM," by Barry P. Mandel, et al.;

U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/314,828, filed Dec. 21, 2005, entitled "MEDIA PATH DIAGNOSTICS WITH HYPER MODULE ELEMENTS," by David G. Anderson, et al.;

U.S. application Ser. No. 11/314,774, filed Dec. 21, 2005, entitled "METHOD AND APPARATUS FOR MULTIPLE PRINTER CALIBRATION USING COMPROMISE AIM," by R. Victor Klassen;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/317,167, filed Dec. 23, 2005, entitled "PRINTING SYSTEM," by Robert M. Lofthus, et al.;

U.S. application Ser. No. 11/331,627, filed Jan. 13, 2006, entitled "PRINTING SYSTEM INVERTERAPPARATUS", by Steven R. Moore;

U.S. application Ser. No. 11/341,733, filed Jan. 27, 2006, entitled "PRINTING SYSTEM AND BOTTLENECK OBVIATION", by Kristine A. German;

U.S. application Ser. No. 11/349,828, filed Feb. 8, 2005, entitled "MULTI-DEVELOPMENT SYSTEM PRINT ENGINE", by Martin E. Banton;

U.S. application Ser. No. 11/359,065, filed Feb. 22, 2005, entitled "MULTI-MARKING ENGINE PRINTING PLATFORM", by Martin E. Banton;

U.S. application Ser. No. 11/363,378, filed Feb. 27, 2006, entitled "SYSTEM FOR MASKING PRINT DEFECTS", by Anderson, et al.;

U.S. application Ser. No. 11/364,685, filed Feb. 28, 2006, entitled "SYSTEM AND METHOD FOR MANUFACTURING SYSTEM DESIGN AND SHOP SCHEDULING USING NETWORK FLOW MODELING", by Hindi, et al.

The following references, the disclosures of which are incorporated by reference relate generally to scheduling in a printing system:

U.S. Pat. No. 5,095,369 to Ortiz, et al. discloses a method for enhancing productivity in an electronic printer incorporating finishing activities and operating in a job streaming mode. Printing and collating of sets of original scanned documents are controlled so that collated sets are successively presented by the printer to the finisher nearly coincident with conclusion of the finishing activity being accomplished for a current job. The system uses a predictive algorithm which is used to increase reliability of printer components by cycling down the printer between jobs in situations where the finishing activity for a current job requires an extraordinarily long time to complete compared with the cycle down/cycle up time of the printer.

U.S. Pat. No. 5,701,557 to Webster, et al. describes an image processing apparatus with a controller and plural modules and a method to define a configuration of the image processing machine.

U.S. Pat. No. 6,856,411 to Purvis, et al. discloses a scheduler for picking an itinerary in a printing machine to schedule the processing of sheets through several modules of the printing machine. The scheduler uses hard "must have" policies and soft "desired" policies to select an itinerary.

U.S. Pat. No. 5,696,893 to Fromherz, et al. describes a method for modeling a printing machine specifying a structure model with its physical and software interface and internal resource requirements, and a behavior model to describe capabilities of a component with its description of work units, transformation of work units, timed events, resource allocations, constraints and restrictions.

U.S. application Ser. No. 10/924,458 filed Aug. 23, 2004 entitled PRINT SEQUENCE SCHEDULING FOR RELIABILITY, by Robert M. Lofthus, et al. discloses a scheduler for a printing system including a plurality of printers which schedules a sequence for printing a plurality of print jobs by the printers based on minimizing printer downtime or maximizing continuous printer run time.

U.S. application Ser. No. 11/137,634, filed May 25, 2005 entitled "PRINTING SYSTEM," by Robert M. Lofthus, et al., discloses a scheduler for a printing system including a plurality of processing units wherein the system model indicates characteristics of each processing unit. Received print jobs are scheduled for processing via one or more job streams by optimizing a utility function that is dependent upon user selected parameters, the job schedule, and the system model.

The following references, the disclosures of which are incorporated by reference in their entireties, relate to what have been variously called "tandem engine" printers, "parallel" printers, or "cluster printing" (in which an electronic print job may be split up for distributed higher productivity printing by different printers, such as separate printing of the color and monochrome pages), and "output merger" or "interposer" systems: U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al.; U.S. Pat. No. 4,579,446 to Fujino; U.S. Pat. No. 5,489,969 to Soler, et al.; a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced."

BRIEF DESCRIPTION

A system for handling objects includes a first image marking engine operative to mark objects, and a second image marking engine operative to mark objects. In addition, the system includes a first object delivery path operative to transport objects presented by the first image marking engine to a first destination. A second object delivery path is operative to transport objects presented by the second image marking engine to a second destination. The first and second destinations may be a single destination, separate destinations, or interchangeable destinations. At least one object is identifiable to isolate at least one aspect of a delivered object. The at least one object includes an associated object itinerary representing at least one object route through the system. A controller is provided to query the object itinerary to correlate the at least one aspect to at least one of the first image marking engine, the second image marking engine, the first object delivery path, and the second object delivery path.

A xerographic system is provided which includes a first image marking engine, a second image marking engine, a first sheet delivery path, and a second sheet delivery path. The system further can include a sensor element operative to sense at least one aspect of a media sheet. A controller is provided to query a sheet itinerary to correlate the at least one aspect to at least one of the first image marking engine, the second image marking engine, the first sheet delivery path, and the second sheet delivery path.

A method is provided for fault isolation in a multiple marking engine system, the method comprises printing a first image with a first marking engine, printing a second image with a second marking engine, transporting the first and second images along first and second transport paths to an output device, logging the first image and the second image to their respective marking engines and transport paths, and, isolating a fault to at least one of the first marking engine, second marking engine, first transport path, and second transport path.

DETAILED DESCRIPTION

Figure 1:
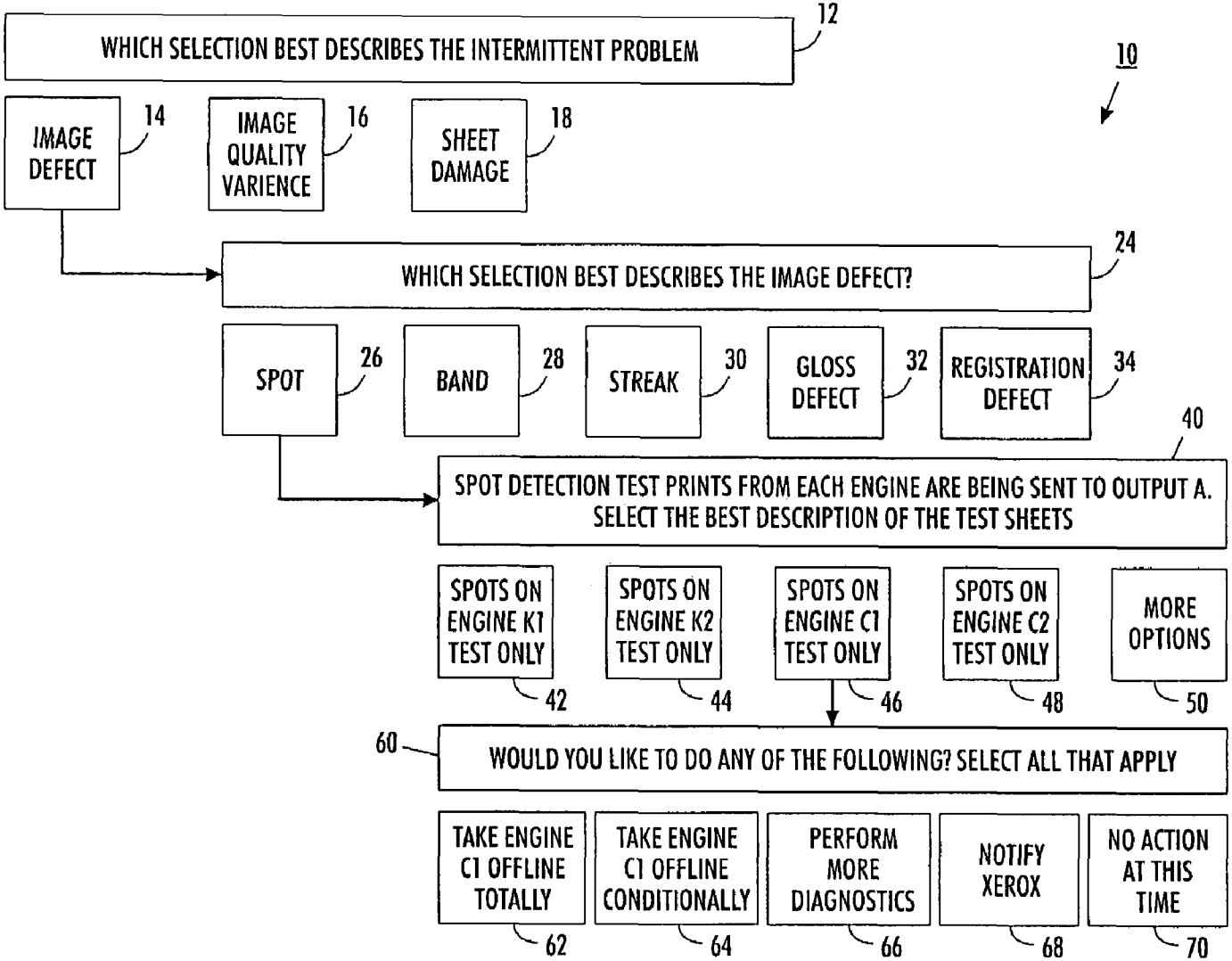
FIG. 1 is a block diagram outlining example steps within a method for correlating print defects to one or more components of an integrated printing system and for controlling print jobs.

A set of tests procedures and supporting devices is described hereinafter to aid in the identification and/or isolation of print defects and print quality shortfalls in integrated document processing systems. These can include a viewable log or database of integrated test print analysis results, a hard copy annotation of test print results on the associated test print sheet, a query of sheet itineraries and sheet properties associated with a printed job, and a correlation of a print defect, shortfall or variance to one or more components through automated systematic routing of prints and/or operator observation. Alerts can also be issued to the operator when an automated procedure isolates a potential problem. The system operator is given the option to manually take a particular component offline for all jobs, or conditionally offline for designated jobs or sheet requirements. A user interface displaying a highlightable system map or diagram is also proposed for aiding the operator in comprehending and responding to debug procedures and results.

Prints of diagnostic targets from each image marking engine can be routed to an image sensor module periodically for measurement of density, color, registration, image defects (such as bands or streaks), or other image attributes (see application Ser. No. 10/917,676 filed Aug. 13, 2004). application Ser. No. 10/917,676 is incorporated by reference in its entirety. Appropriate corrective action could then be implemented through the marking path and/or the image path of each engine to achieve consistency among the prints from all engines. Alternatively, prints requiring particular performance (color gamut, for example), could be routed to the engine best able to achieve that performance at the time of printing. To be described in more detail hereinafter is one or more ways to inform the operator of the test results associated with each IME. It is proposed that a log can be saved of the test results for each IME, and reports be made available to the operator by either a display or hard copy printout. The operator would be able to specify parameters of the report, such as reporting frequency for period tests, specific details to be included/excluded in a given report and the log interval to be included in the report.

Numerical results from diagnostic print tests are not necessarily good indicators of all print quality attributes that may interest an operator. This may be either a limitation of the metrics and the diagnostic process, or it may reflect an operator's lack of experience in interpreting the metrics. In either case, an operator may wish to simultaneously view the diagnostic print and the diagnostic results associated with each IME.

Diagnostic prints and test results can be aggregated on a single page by exploiting the sheet recirculation and overprinting capabilities of integrated image marking engines, as well as the common sensor as described above. If overprinting is available (i.e., the system is compatible with marking a single side more than once), it may be desirable to annotate diagnostic prints with the test results generated by evaluating the print. The sequence of events can be as follows: a test print pattern is scheduled to be printed by an IME and then routed to the common sensor module for evaluation; after evaluation the results are fed back to a controller to generate a report; the test print page is recirculated into the print stream; and, the report is formatted and scheduled to be overprinted on the test print from which the report data was generated. Overprinting also allows diagnostic patterns from more than one IME to be printed on the same side of the same sheet. In this case, the reports for each IME could be formatted on a single page format to clearly annotate the results for each IME. For some multiple integrated marking engine systems, overprinting may not be available (i.e., is not designed to print more than one impression on a given side of a sheet). In such a case, diagnostic results could be printed on the back side of the diagnostic sheets. If diagnostic sheets cannot or are not recirculated into the print stream, they can still be annotated prior to evaluation with information that is not dependent on test results. For example, the test sheet could include documentation of the IME used to produce the print, the time and date the print was generated, a test pattern I.D. number, and a test result reference number for use with a log as described above.

One or both of the object sources can be image marking engines or rendering devices. An interposer, or system of sheet transportation paths, routes or transports sheets presented by the marking engines or rendering devices to output devices or to the sensor module. The sensor module can include one or more sensor elements.

To produce and assemble the sheets of a print job on a system with multiple marking engines and sheet paths, the system controller must have a scheduling function. The scheduler can produce itineraries for sheets or objects as described within a job using a model of the machine. The model of the machine encodes the capabilities of all system modules, such as feeders, marking engines, sheet transports and finishers, and also includes how the system modules are connected. A sheet itinerary is a description in time of media passing through the system and all the associated marking engines, transport paths and other system modules As discussed above, querying of sheet itineraries and sheet properties can associate particular components of the integrated printing system with one or more pages of a printed job. The IME(s) responsible for an image defect (or the paper path itinerary associated with sheet damage) can be determined or narrowed based on an analysis of the digital image sheet properties and the sheet itineraries generated during sheet scheduling. This method may be preferred if the image defect or sheet damage is noticed on particular pages of a print job. In this case, the operator may be able to isolate the problem without running test prints. This is done by entering information into the controller regarding which sheets contained defects and categorically selecting the defect type. The controller can then automatically query the log regarding the sheet properties and itinerary for those pages, and produce a list of possible sources rated with an estimated probability of cause. The operator can then use his or her judgment regarding the completeness of the troubleshooting process, and decide on a next course of action.

The troubleshooting method can use semi-automated strategies to isolate a malfunctioning component. A very simple example is for the operator to call up a troubleshooting application and indicate the intermittent presence of an image defect. The machine then prints one or more test sheets from each IME with the IME identified on each sheet. The operator is then prompted to indicate on which sheet (if any) the defect is visible. If an IME is indicated, the operator is provided the information necessary to decide on a next course of action. The application may prompt the operator to choose between no action, a manual shutdown, a partial shutdown, or further diagnostics. The operator may be prompted for additional information to better match the isolation strategy to the type of fault. Example steps that can be included in the prompting process are illustrated in FIG. 1.

Periodic calibration, image quality, and image quality consistency procedures are intrinsic to the multiple integrated marking engine platform. Certain test results from these procedures are suitable for automatic component fault detection (e.g., an unacceptably high image non-uniformity metric that cannot be compensated for by image quality controls). In such instances, it is appropriate to alert the operator of a potential issue, and prompt the operator for next actions.

Once it is determined which system components are producing image defects or sheet damage, the operator is provided the option to declare the components "offline" or "conditionally offline" on a job by job basis or by a job attribute basis. The declaration changes the model of the machine used to schedule sheets in the same manner that the model of the machine would change in response to an automatic shutdown based on sensing.

For many procedures, a graphical representation of the system can create a more intuitive interface environment. In particular, some views of the user interface would be enhanced by schematic map of the system showing a cutaway view, see for example FIG. 3, of the major xerographic and paper path components. One view could display color coded indicators of the status of each component (online, conditionally offline, or offline). The components could also be selectable by point and click when the operator wishes to perform various actions for the component. Example actions for a given component might be to get a more detailed status/history report, manually changing status from offline to conditionally offline, and running a debug or recalibration procedure.

Referring to FIG. 1, a system and method for fault isolation and operational control is therein illustrated. An exemplary 'image defect' fault 10 is illustrated with a corresponding correlation analysis and subsequent operator options are shown. A selection can be made that describes the intermittent problem 12. Exemplary intermittent problems 12 can include image defects 14, image quality variances 16, sheet damage 18, etc. If the problem includes an image defect 14, the problem can be further narrowed 24, for example, to a selection of spot 26, band 28, streak 30, gloss defect 32, registration defect 34, etc. Once the type of image defect 14 is identified, the marking engine creating the fault can be isolated. Spot detection test prints 40 from each marking engine can be printed and sent to a single output. The test prints 40 are then analyzed to determine which engine is creating the faults. For example, are the spots on sheets produced by marking engine K1, K2, C1, or C2, referenced by 42, 44, 46, and 48, respectively. Additionally, more options 50 may be programmed. Initiation of the fault correlation method can be from a variety of sources. For example, an operator may observe an intermittent defect on given pages of a print job. The operator then starts the fault isolation application and inputs the job ID and page numbers for the observed defective pages. The controller is then able to query the itinerary database and evaluate itineraries for each sheet involved. Evaluation of the sheet itineraries will generally narrow the probable cause for the defect and focus any further prompts for user input. Alternatively, the fault isolation application may start when the operator responds to a warning flag or alert based on automatically scheduled and executed diagnostics procedures.

After system module, i.e. a marking engine or other system element, has been identified, the operator can be presented with options for controlling subsequent print jobs 60 through the printing system. The operator's options can include taking marking engine C1 offline completely 62, taking marking engine C1 conditionally offline 64, performing more diagnostics 66, notifying a repair center 68, taking no action 70, etc. Similarly, the problem can be an image quality variance 16, sheet damage 18, et. al., with the corresponding identifying of the particular image defect and correlating of the defect to the source of the fault (not shown).

Figure 2:
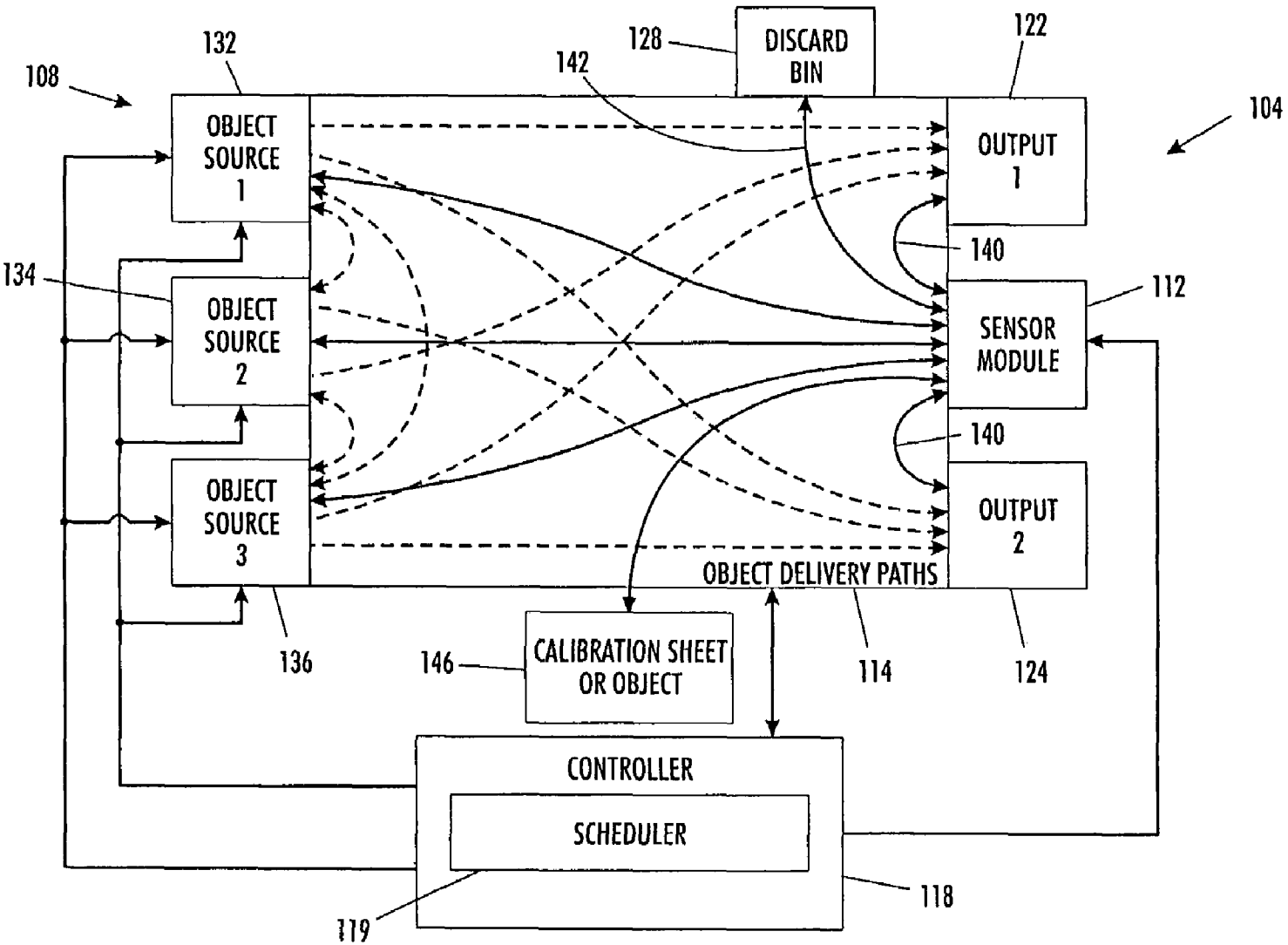
FIG. 2 is a block diagram of a multi-object source system including a sensor module and a plurality of object delivery paths whereby objects produced, generated, presented, or delivered by each of the plurality of object sources may access the sensor module.

Referring to FIG. 2, a system 104 for handling objects or sheets is shown and can include a plurality of object sources, a sensor module 112 (i.e. user observation or set of sensing elements), and a plurality of object delivery paths 114. A plurality of sensor elements may be included in a single sensor module enclosure or zone or housed or mounted separately. The phrase—sensor module—is used herein to refer to a collection of one or more sensor elements whether they are co-located or mounted separately, as long as output from any object source or marking engine in the system can be transported to any sensor element and one particular sensor element is used to sense any particular kind of aspect. A system may include additional sensors that do not meet these criteria. Since one sensor module, or set of sensing elements, is used to measure or test output from a plurality of marking engines, sensor to sensor variability is removed as a source of error when comparing the output of the plurality of marking engines. Therefore, consistency of system output is improved.

A controller 118 is operative to orchestrate or control sensing or diagnostic sessions and/or adjust aspects of the object sources. In some document processing embodiments the controller can adjust document process actuators to correct errors reported by the sensor module. Additionally, or alternatively, video or image path data can be adjusted or altered to compensate for some facet or aspect of performance of one or more marking engines. Some embodiments provide for constraining a scheduler, based on measurements from the sensor module, so that critical portions of a document processing job are rendered only on those marking engines that can render the critical portions within some specified tolerance or accuracy.

The system 104 may include main outputs, such as a first output 122 and a second output 124. A third output, may be designated as a discard bin 128.

In one exemplary system 104, the plurality of object sources includes a first object source 132, a second object source 134 and a third object source 136. The object sources 108 can be any object sources wherein one or more aspects of objects delivered by the object sources 108 are beneficially sensed on an occasional or periodic basis in order to detect and correlate for aspects of the object delivery, production, generation, presentment or handling process of the system 104.

For example, where the exemplary system 104 is a document processor, the plurality of object sources 108 may include document sources such as trays of preprinted sheets, input paper trays and/or rendering devices or integrated image marking engines. For instance, where the first object source 132 is an integrated image marking engine, an exemplary or test sheet may be carried from the first object source 132 to the sensor module 112 via an object delivery path 114. The sensor module 112 may determine an image defect associated with the exemplary sheet supplied by the first object source 132. Additionally, or alternatively, the sensor module may determine registration information associated with the exemplary sheet. This information may be used to adjust or control some aspect of the object sources 108, for example, for further printing.

For instance, if the second object source 134 is to print an opposing page in an assembly, adjustments may be made so that rendered pages from the second object source 134 match the colors or shading from the first object source 132.

Alternatively, pages from the first object source 132 might be delivered to the second object source 134 so that the second object source 134 might provide additional markings to the pages. In that case, registration information provided by the sensor module 112 can be used to better register, align or place the marks provided by the second object source 134.

Sample or diagnostic sheets generated or provided by the second object source 134 may also be transported by the object delivery paths 114 to the sensor module 112, where they may be sampled, sensed, examined or studied to provide information for fine tuning registration and/or color matching or shading aspects of the marking process.

Where the plurality of object sources 108 includes a plurality of marking engines, the sensor module 112 may be used to identify and ensure that output from each of the marking engines is consistent or compatible with output from one or more of the other marking engines, or is acceptable to the job requirements. Additionally, or alternatively, information from the sensor module 112 may be used by the controller to select one or more of the plurality of object sources 108 for processing, generating or producing particular portions of a document processing job. Also, information from the sensor module 112 may be used to select one or more of the plurality of object sources for shutdown, i.e. taken offline.

For instance, as will be explained in greater detail below, at the beginning of a document processing job, at the command of a user or system operator, and/or at regular intervals (e.g., measured in time or production units), the controller 118 and scheduler 119 sequentially generate itineraries for diagnostic sheets to be printed at the first, second and third object sources and transported by object delivery paths 114 to transport the diagnostic sheets (e.g., sequentially) to the sensor module 112. It is to be appreciated that the operator can review any of the sheets in a production run for any aspect of interest and convey direct observation to the controller through a user interface. Alternatively, or in conjunction with operator observations, the sensor module 112, or set of sensor elements, may determine aspects or characteristics of the production of marks on sheets from each of the object sources (132, 134, 136). For example, current image defects and registration information may be collected for each of the object sources (132, 134, 136). The controller 118 may compare job description information with the image defect information provided by the sensor module 112. For example, portions of the document processing job calling for marks at an extreme portion of a color gamut may be directed for processing to a selected one of the plurality of object sources (132, 134, 136) that the sensor module 112 reports is currently able to produce colors in that range. Alternatively, the controller 118 may determine an object source not able to produce the desired job requirement and take the respective object source offline, so that production of any portion of the job is within the capabilities of any of the remaining object sources. These processes and others will be described in greater detail below.

Image quality variance information can include color calibration information. Therefore, information from the sensor module 112 may be used to adjust, compensate or apply calibration information to image data to customize or calibrate the image data for rendering or printing by a selected one of the object sources (132, 134, 136). For instance an actual tone reproduction curve or engine response curve may be determined or measured by the sensor module 112 for a target or selected one of the object sources. The actual tone reproduction curve is compared to an ideal, desired or target tone reproduction curve and a compensating or calibrating tone reproduction curve is generated. The compensating or calibrating tone reproduction curve is applied to image data so that the desired colors of the image data are rendered by the selected or target rendering device.

As mentioned above, the exemplary system 104 can include one or more main outputs (122, 124). The main outputs 122, 124 may provide additional processing or may simply be output collecting bins or trays. For instance, where the exemplary system 104 is a document processor the output devices 122, 124 may provide finishing services, printing services, or output collection services. For example, the first output 122 may be a stapler, binder or shrink wrapping device. The second output 124 might be a simpler document or sheet collection tray or collator.

In some embodiments, sheets directed to the sensor module 112 may be regular object source production or delivery items. As such, sensed objects might be properly directed to an output device (e.g., 122, 124) when the sensor module 112 is finished examining, sensing or studying them. In such embodiments, paths 140 are provided for directing objects from the sensor module 112 to one or more output devices (e.g., 122, 124). In embodiments where sensed objects are special or diagnostic in nature, it may be inappropriate to direct sensed objects to output devices intended for normal or main production items. In such embodiments, after the sensor module 112 examines, studies, samples or senses a diagnostic object, the diagnostic object may be directed along a discard path 142 to the discard bin 128. For example, in a document processor, the discard bin 128 might be a purge tray to which sample jobs, diagnostic sheets and other non-main job items may be directed.

Systems such as exemplary system 104 that include a sensor module (e.g., 112), or a set of sensing elements (co-located or mounted separately), for examining, studying, sampling or sensing aspects of objects produced or provided by a plurality of object sources (e.g., 108) have an advantage over systems that only provide dedicated sensors for each individual object source. In systems with sensors that are dedicated to only individual object sources, the sensors themselves may become a source of error with regard to object source to object source variation. For instance, if each object source in a plurality of object sources included a dedicated color sensor and there were no sensor module (e.g., 112), or set of sensing elements, common to the plurality of object sources, then a color sensor that drifts overtime and becomes more sensitive to, for example, red, may report that the print engine associated with the drifting sensor includes a color gamut that extends further into the red than the dedicated color sensors associated with the other object sources report with regard to their associated print engines. This misinformation might cause a controller to misdirect a red portion of a document printing job to the object source associated with the drifting sensor reporting a redder gamut. Since such qualitative decisions in the exemplary system 104 are based on a sensor module 112, or set of sensing elements, that is, in effect, common to all the object sources (e.g., 132, 134, 136), even if the sensor module 122 includes drifting sensing elements, the relative or qualitative relationship between the object sources will still be reported correctly. That is, for example, the object source having a gamut extending furthest toward the red will be correctly identified, even if the exact hue and saturation of that red is misreported by a drifting sensor.

To minimize or compensate for any remaining issues due to sensor drift, the exemplary system 104 may include provision for providing a calibration sheet or object 146 including one or more calibration targets for occasional, periodic, or on-demand recalibrating of the one or more sensing elements included in the sensor module 112, or set of sensing elements.

For example, at an appropriate time, a system operator provides the calibration sheet or object 146 at a calibration sheet input and directs the system to calibrate one or more sensor elements of the sensor module 112. The controller 118 and scheduler 119 create an itinerary that direct the set of object delivery paths 114 to transport the calibration sheet or object from the calibration sheet input to the appropriate sensing element. When the calibration sheet or object 146 is delivered to the sensing element of the sensor module 112, the controller 118 may direct or orchestrate the appropriate calibration procedure. At the conclusion of the calibration procedure, the controller 118 may direct the set of object delivery paths 114 to remove the calibration object or sheet 146 from the field of view of the sensing element. For example, the controller 118 may direct the object delivery paths 114 to transport the calibration object or sheet 146 to the discard bin 128.

It is to be noted that, while the sensor module 112 of the exemplary system 104 is illustrated as being at a single location, in some embodiments sensing elements of the sensor module may be distributed throughout the system, as long as each sensing element can receive diagnostic objects from any of a plurality of object sources, and one sensing element is used to sense any particular aspect of diagnostic objects.

The object delivery paths 114 may include any transportation mechanism appropriate to the system 104. The object delivery paths 114 may include means for redirecting or steering objects from, for example, an object source to an output, from an object source to the sensor module 112, or from one object source to another object source. Where the system 104 is a document processor, the object delivery paths 114 may include, for example, cylindrical nip drive rollers, spherical nip spin roller drives, air transport modules and/or conveyer belts.

Figure 3:
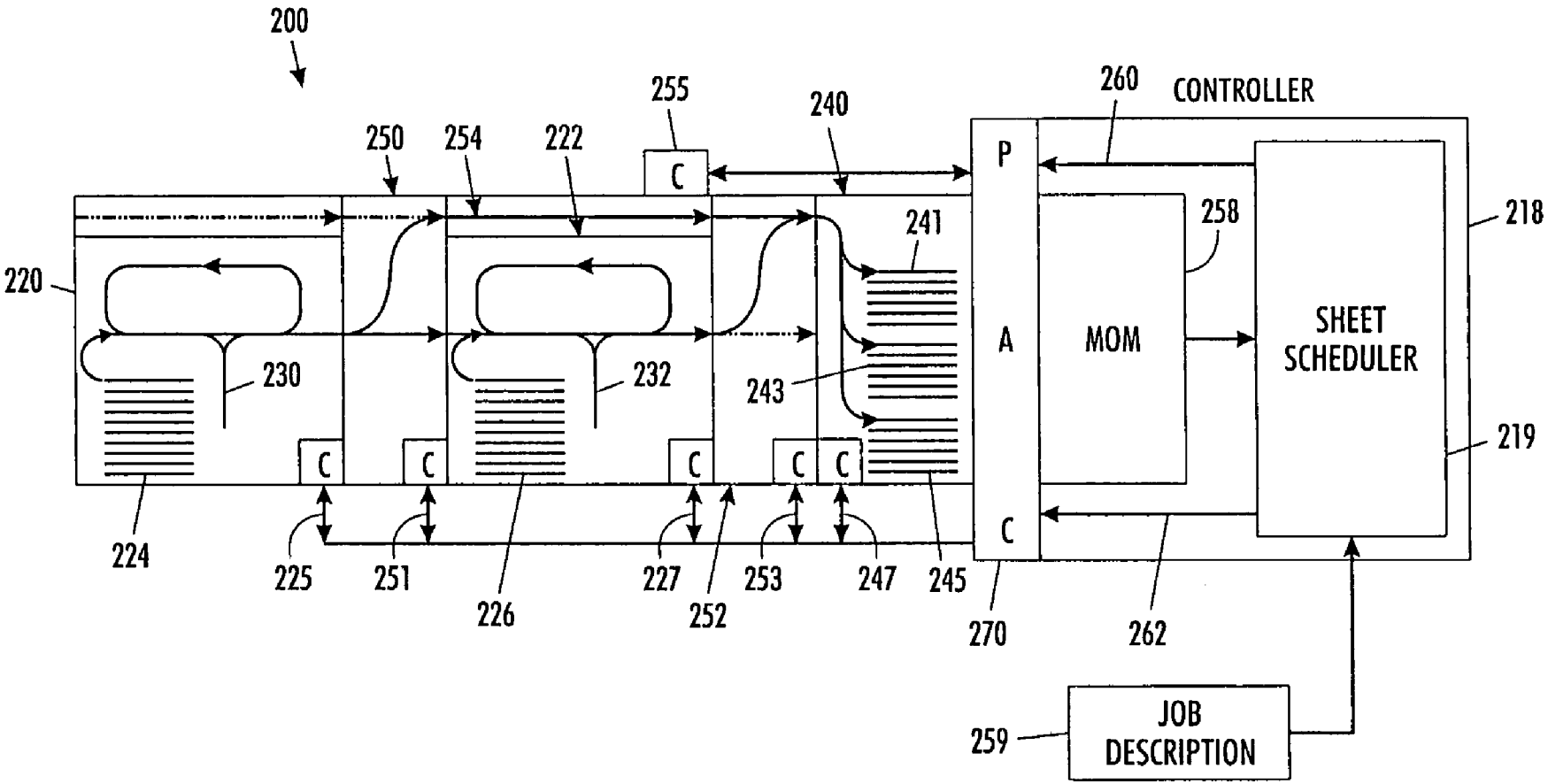
FIG. 3 is an exemplary diagram of a printing system including a plurality of document paths; and, FIG. 4 is a diagram of a document processor including a sensor module and plurality of document paths, each of the document delivery paths having access to an auxiliary path for delivering objects to a sensor module.

Referring now to FIG. 3, the following description comprises one example of sheet itineraries for a printing system 200. The exemplary system 200 can include two printer modules 220, 222 (object sources) each with their own paper supplies 224, 226. Each printer module 220, 222 can include the capability of feeding and printing a simplex sheet and delivering it to an exit 240 in a specified time. It is to be appreciated that the elapsed time to produce a simplex print for each printer module 220, 222 can vary, i.e. if one module is a color printer 220 and the other module is a black printer 222. Additionally, the modules 220, 222 can include the capability of inverting sheets via inverters 230, 232, respectively, prior to delivering to the exit 240. Further, the modules 220, 222 can include the capability of printing a duplex sheet and then delivering to the exit 240 in a specified time, etc. Each of the above described capabilities includes its own processing time. As will described in more detail below, the system 200 can include different paper transport modules 250, 252, 254 for transporting media sheets through the system 200, for example, through, around or between selected printer modules. Depending upon which paper transport path is selected, a transport time is determined (i.e. the time between entry and exit) 251, 253, 255 and processed by a sheet scheduler 219 and controller 218. Similarly, media sheets can be transported to one or more finishing modules 241, 243, 245 having distinct finishing locations or destinations. Each of the finishing locations 241, 243, 245 will include a processing time for transporting a sheet from the entrance of the finishing module 240 to the finishing destination. Each module within the system 200 can include its own module controller which passes the respective capabilities (i.e. active and inactive) of that module, as well as the connections to neighboring modules, to the system controller 218 thus creating the model of the machine (MOM) 258. The sheet scheduler 219 within the system controller 218 uses the MOM 258 and the sheet level description of a job to create itineraries 260, 262 for each physical sheet passing through the system. The itineraries 260, 262 are negotiated by the system controller 218 with each module controller that has a capability needed for a particular itinerary through a propose, accept/reject, confirm (PAC) 270 protocol, etc. It is to be appreciated that the controller 218 is in communication with a user interface for receiving and displaying job requests, capabilities, itineraries, etc.

Figure 4:
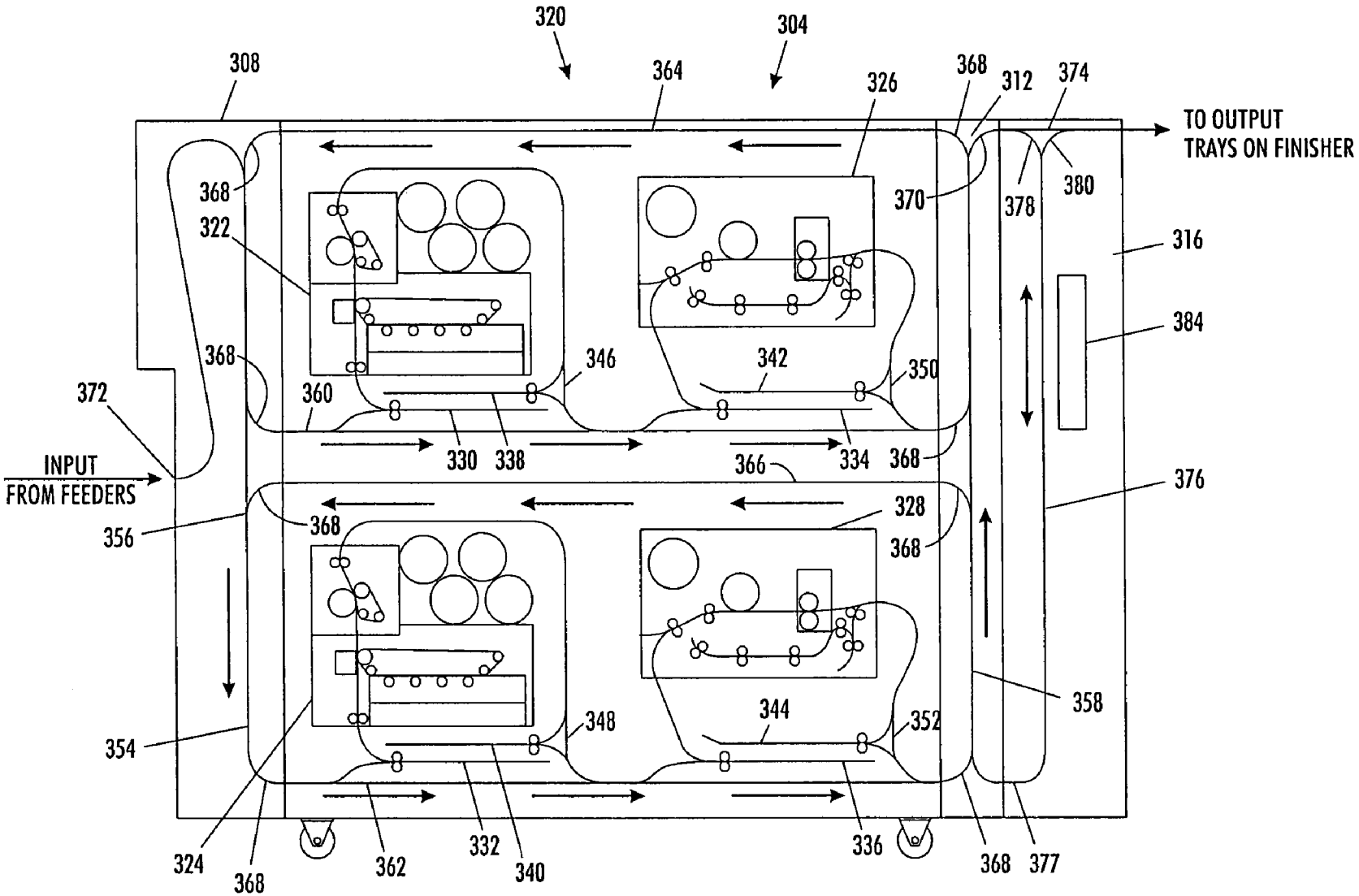

Referring to FIG. 4, another system or processor 304 is illustrated including a distributor 308, a collector 312, an output interface module 316 and a plurality 320 of integrated marking engines (IMEs) including a first 322, second 324, third 326 and fourth 328 integrated marking engines. For instance, the first and second 322, 324 IMEs are color integrated marking engines and the third and fourth 326, 328 render images using only a single colorant (e.g., black). Each of the first, second, third and fourth IMEs 322, 324, 326, 328 include input inverters 330, 332, 334, 336 and output inverters 338, 340, 342, 344 respectively. The output inverters 338, 340, 342, 344 are associated with inverter bypasses 346, 348, 350, 352. An interposer 354 provides a plurality of overlapping object delivery paths for transporting objects (e.g., sheets or pages) from the distributor 308 to the IMEs 322, 324, 326, 328, the collector 312 and/or to the output interface module 316.

The interposer 354 includes a downward path 356, an upward path 358, first and second output bound paths 360, 362 and first and second return paths 364, 366. Interconnects 368 link the output bound and return paths 360, 362, 364, 366 with the downward 356 and upward 358 paths and, thereby, with each other. Therefore, the interposer 354 provides paths for transporting objects (e.g., pages, sheets) from any IME to any other IME and from any IME to an output interconnect 370 for delivering the objects (e.g., sheets or pages) to the output interface module 316.

For example, a sheet received at an input 372 of the distributor 308 is transported to the downward path 356 of the interposer 354. From the downward path 356 the sheet may be delivered to either the first 360 or second 362 output bound paths. From there, the sheet or page may enter any of the IMEs 322, 324, 326, 328 through their respective input inverters 330, 332, 334, 336. Once processed by the selected IME 322, 324, 326, 328 the sheet or page is delivered back to the output bound path 360, 362 from which it was received.

In this exemplary embodiment, the sheet or page may be delivered back to the output bound path 360, 362 either directly, via the output inverter bypass 346, 348, 350, 352 or after being inverted by the respective output inverter 338, 340, 342, 344.

Once delivered to the output bound path 360, 362 the sheet or page can be delivered to an adjacent IME (e.g., 326, 328) or delivered to the upward path 358 portion of the interposer 354 to be transferred to a return path 364, 366 or to the output link 370 and output interface module 316. From the return paths 364, 366 the page or sheet can be transferred to the downward portion 356 of the interposer 354 and routed to the input of any of the IMEs 322, 324, 326, 328 from the output bound paths 360, 362 as described above.

The output interface module 316 includes an output path 374, an auxiliary path 376 and first and second output interface links 378, 380 interconnecting the auxiliary path 376 with the output path 374. Additionally, the output interface module includes a sensor module 384, or set of sensor elements, positioned adjacent to the auxiliary path. The interposer 354, the output link 370 and the first output interface link 378 provide a path from any of the IMEs 322, 324, 326, 328 to the auxiliary path 376 and thereby to the sensor module 384. For example, a first object delivery path includes the first outbound path 360, an upper portion of the upward path 358, the output link 370, the first output interface link 378 and the auxiliary path 376. The first output path can carry sheets or pages from the first or third IME 322, 326 to the sensor module 384. A second object delivery path includes, for example, at least a portion of the second output bound path 362, the upward path 358, the output link 370, the first output interface link 378 and the auxiliary path 376. The second output path can transport objects (e.g., sheets or pages) from the second and fourth IMEs 324, 328 to the sensor module 384. Path element 377, a continuation of path element 376, can return sheets or pages back from the sensor 384 to the lower part of upward path 358 and thence to any of the IMEs for further marking as discussed hereinafter.

In other embodiments, the sensor module 384, or sensor elements of the sensor module, may be positioned adjacent to some portion of the interposer 354. The interposer may transport an object from any portion of the interposer to any other portion of the interposer 354. Therefore, there exists a path from any of the IMEs or object sources 322, 324, 326, 328 to any portion of the interposer 354 adjacent to which the sensor module 384, or a sensor element thereof, might be positioned. However, positioning the sensor module, or sensor element, adjacent to an auxiliary path, outside the flow of main document processing job production, allows diagnostic sheets to be studied, analyzed, examined, correlated, and/or sensed over an extended period of time without disrupting or slowing down main job production.

Since positioning the sensor module adjacent an auxiliary path (e.g., 376) allows diagnostic sheets to be examined, studied, analyzed and or sensed over a prolonged period of time, slower (high integration time) sensors may be included in the sensor module 384. Slower sensors are often less expensive than their high speed counterparts. Additionally, positioning the sensor module 384 adjacent to an auxiliary path provides time for taking repeated measurements which can be averaged or otherwise combined to compensate for variance in sensor readings.

Wherever the sensor module 384 is placed, a controller schedules the production of diagnostic prints and controls their delivery to, and examination by the sensor module 384. Information regarding sensed aspects of the diagnostic sheet is transferred from the sensor the controller. The controller may use the information regarding the sensed aspects to make adjustments to the rendering process of the IMEs (e.g., 322, 324, 326, 328).

Information regarding a sensed aspect of a diagnostic image may also be used to adjust a production schedule. For example, the controller may elect to have a particular portion of a document processing job rendered on the second IME 324 because, for example, a color gamut of the second IME 324 better accommodates the requirements of the document processing job, thereby limiting the rendering processes of one or more of the other IMEs.

The job description of a subsequent job can include user requirements coupled with system limitations or manual module shutdown options. For example, a user may indicate that a job or a portion thereof be limited to a particular IME. Such user limitations are processed as additional constraints in the scheduling process. Since the interposer provides the sensor module with access to output from all of the IMEs of the plurality of IMEs, the scheduler has access to information for sorting the capabilities of the IMEs, which allows the scheduler to comply with such user limitations or requests.

Additional IMEs may be scheduled or directed to place marks on the diagnostic sheet and the interposer and video compensator would be scheduled or directed to deliver the sheet and image data to the additional IMEs. When production of the diagnostic sheet is complete the interposer delivers the diagnostic sheet to the sensor module. The sensor module senses, examines or records aspects of the diagnostic sheet and delivers information regarding the sensed aspects to the sensor module interface. For example, depending on the sensors installed in the sensor module, the sensor module may deliver information regarding intra IME registration, inter IME registration, color gamut, color or shading calibration, toner density, banding, streaking, and gloss. Of course, this list of diagnostic sheet aspects is exemplary only. Other aspects of diagnostic sheets may also be sensed. Additionally, the itinerary of the diagnostic sheet is recorded whereby the controller can query the itinerary in order to correlate the fault information to the respective marking engine and/or delivery transport.

When the analysis of the diagnostic sheet is complete, the interposer may transport the diagnostic sheet away from the sensor module. For example, the interposer may deliver the diagnostic sheet to the discard bin or back to an IME for further marking to document information gained from the sensor reading, etc.

Diagnostic events may be triggered on the basis of any aspect of production appropriate to controlling or compensating for a desired aspect of image quality. However, it is anticipated that many of the aspects of image quality forwhich embodiments will be implemented to compensate or correct for will be static or semi-static in nature. That is, many of the aspects of image quality correlated by embodiments of the methods and systems, described above, will change only slowly, with changes being detectable only over periods of many minutes, hours, days or months. Some aspects will change due to marking engine wear. Some aspects will vary based on ambient or machine temperature and/or humidity. Thermal expansion and contraction, charge retention, toner age and ability to de-agglomerate, ink viscosity, developer and nip wear and laser or light source efficiency are just a few aspects of document processing systems that affect image quality and which change slowly overtime or with the number of images printed or rendered.

Default triggering events may be selected or configured by system designers. Additionally, or alternatively, embodiments may provide for document processing system operators to configure appropriate diagnostic event triggering events. For instance, a first kind of diagnostic event may be triggered whenever a document processor is powered up or started. Additionally, or alternatively, a diagnostic event may be triggered on a regular basis, such as, every 20 minutes or whenever some predetermined number of sheets or images are printed or rendered. Still other diagnostic events, may be triggered on the basis of temperature or humidity changes. Additional iterations may be triggered as required or as a matter of course. Of course, diagnostic events may be triggered at the request or direction of a system operator.

As indicated above, taking corrective or compensatory action can be based on the desire for absolute accuracy or relative accuracy. Providing a single sensor for each aspect of image quality or consistency to be used to sense that aspect with regard to all the image or object sources in a system removes sensor variation as a source of consistency errors. While system embodiments have been described with reference to single sensor module including one or more sensors adjacent to a single auxiliary path, it is to be understood that some embodiments may include a plurality of sensor modules and/or a plurality of individual sensors adjacent one or more auxiliary or main paths as long as any particular aspect of production is measured by the same sensor element independent of which marking engine or object source provides, renders or produces the image or object to be sensed.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A system for handling objects, the system comprising:

a first image marking engine operative to mark objects;

a second image marking engine operative to mark objects;

a first object delivery path operative to transport objects presented by the first image marking engine to a first destination;

a second object delivery path operative to transport objects presented by the second image marking engine to a second destination, wherein the first and second destinations may be a single destination, separate destinations or interchangeable destinations;

at least one object identifiable to isolate at least one aspect, the at least one object includes an associated object itinerary representing at least one object route through the system;

a controller to query the object itinerary to correlate the at least one aspect to at least one of the first image marking engine, the second image marking engine, the first object delivery path, and the second object delivery path; and, at least one additional image marking engine operative to mark objects;

at least one additional object delivery path operative to selectively recirculate objects presented by the first image marking engine, the second image marking engine and the at least one additional image marking engine back to the first image marking engine, the second image marking engine, or the at least one additional image marking engine.

2. The system of claim 1, further including a sensor module operative to sense the at least one aspect of, the at least one sensor module being accessible from the first object delivery path and the second object delivery path.

3. The system of claim 1 wherein an operator provides information on at least one aspect to the controller.

4. The system of claim 2, wherein the controller logs the itinerary and correlation of the at least one aspect.

5. The system of claim 4, wherein the at least one object is an operator generated test object.

6. The system of claim 4, wherein the at least one object is an automatically generated test object.

7. The system of claim 5, wherein the at least one sensor module is accessible from the first and second object delivery paths via an auxiliary path.

8. The system of claim 6, wherein the controller includes options for an operator to limit at least another object itinerary for at least another subsequent delivered object.

9. The system of claim 8, wherein the at least another object itinerary includes at least another object route through the system.

10. The system of claim 8, wherein the controller includes a graphical user interface.

11. The system of claim 8, further including:

the at least one additional object delivery path operative to transport objects presented by the at least one additional image marking engine to at least one additional destination, wherein the first, second and the at least one additional destinations may be a single destination, separate destinations or interchangeable destinations;

wherein the sensor module is additionally accessible from the at least one additional object delivery path; and, the controller is additionally operative to adjust at least one aspect of the first, second, and the at least one additional image marking engines, and the first, second, and the at least one additional object delivery paths.

12. A xerographic system comprising:

a first image marking engine;

a second image marking engine;

a first sheet delivery path;

a second sheet delivery path;

a sensor element operative to sense at least one aspect of a diagnostic media sheet a controller to query a sheet itinerary to correlate the at least one aspect to at least one of the first image marking engine, the second image marking engine, the first sheet delivery path, and the second sheet delivery path; and, the controller is operative to selectively direct at least another sheet alternatively: from the first image marking engine to the second image marking engine, from the first image marking engine and around the second image marking engine, and from the second marking engine to the first marking engine.

13. The system of claim 12, wherein the controller is operative to direct at least another sheet and, if appropriate, limit an aspect of at least one of the first image marking engine, the second image marking engine and a document processing job based on the received aspect information.

14. The system of claim 12, wherein the controller is operative to adjust the document processing job by scheduling a selected portion of the document processing job for production on a selected one of the first image marking engine and the second image marking engine based on a content of the selected portion of the document processing job and an aspect of performance of the first and second image marking engines determined from information provided by a sensor element regarding the at least one aspect of a diagnostic media sheet.

15. A method for fault isolation in a multiple marking engine system, the method comprising:

printing a first image with at least a first marking engine;

printing a second image with at least a second marking engine;

transporting the first image along at least a first transport path to an output device;

transporting the second image along at least a second transport path to the output device;

logging the first image and the second image to their respective marking engine and transport path;

isolating a fault to at least one of the first marking engine, the first transport path, the second marking engine, and the second transport path through interval splitting; and, printing at least another image including at least another transport path for selectively transporting the at least another image from the first marking engine to the second marking engine or from the second marking engine to the first marking engine thereby bypassing the fault.

16. The method of claim 15 wherein isolating the fault comprises:

querying a log regarding sheet defects and selecting the defect type; and, querying the log regarding the sheet properties and itinerary for the sheet defects and producing a list of sources of the fault.

17. The method of claim 16 wherein isolating a fault further comprises correlating the fault to at least one of the first marking engine, a second marking engine, the first transport path, and a second transport path through interval splitting.

18. The method of claim 15 wherein isolating the fault comprises:

measuring a first aspect of the first image with a sensor element; and, taking corrective action, if appropriate, based on the measurements of the first aspect.

19. The method of claim 18 wherein taking corrective action comprises limiting a process actuator of at least one of the first marking engine, the first transport path, the second marking engine, and the second transport path.

20. The method of claim 18 wherein taking corrective action comprises limiting image path data for at least one facet of at least the measured first aspect.

21. The method of claim 18 wherein taking corrective action comprises presenting an alert to the system operator.

22. The method of claim 18 wherein taking corrective action comprises generating a constraint to a scheduling process based on at least the measured first aspect.

23. The method of claim 22 wherein generating a constraint to the scheduling process comprises requiring that a first portion and a second portion of a document processing job both be rendered with a selected one of the first marking engine and the second marking engine if the first aspect is not measured to be within a predetermined aspect tolerance.

24. The method of claim 19, wherein the first image is a diagnostic sheet.

25. The method of claim 16, wherein the first image is a diagnostic sheet.

26. The method of claim 15 wherein isolating the fault comprises:

observing a first aspect of the first image by a system operator; and, taking corrective action, if appropriate, based on the observations of the first aspect.

* * * * *